United States Patent [19]

Wilson

[11] 4,369,942

[45] Jan. 25, 1983

[54] SIGNAL CONTROL SYSTEM

[75] Inventor: H. James Wilson, La Grange, Ky.

[73] Assignee: Safetran Systems Corporation, Louisville, Ky.

[21] Appl. No.: 21,695

[22] Filed: Mar. 19, 1979

[51] Int. Cl.[3] ..... B61L 21/00

[52] U.S. Cl. ..... 246/34 CT; 246/34 R

[58] Field of Search ..... 246/34 R, 34 CT, 34 B, 246/41, 58, 187 B, 5; 340/23

[56] References Cited

U.S. PATENT DOCUMENTS

| | | | |
|---|---|---|---|
| 2,581,527 | 1/1952 | Gilson | 246/34 R |
| 2,588,044 | 3/1952 | Reichard | 246/34 R |
| 3,359,416 | 12/1967 | Wilcox | 246/34 CT |
| 3,492,587 | 1/1970 | Hutton | 340/204 X |
| 4,133,504 | 1/1979 | Dobler et al. | 246/187 B X |

OTHER PUBLICATIONS

Hawks, Ellison, *Popular Science Mechanical Encyclopedia,* Popular Science Publishing Co., Inc., New York, (1941), pp. 377–386.

*Primary Examiner*—Reinhard J. Eisenzopf

*Attorney, Agent, or Firm*—Kinzer, Plyer, Dorn & McEachran

[57] ABSTRACT

A railroad signal system includes an A type transmitter and receiver for sending and receiving signal messages in one direction and a B type transmitter and receiver for sending and receiving signal messages in the opposite direction. The A transmitter and the B receiver are located at one end of a signal block and the B transmitter and A receiver are located at the opposite end. The A transmitter provides an A type DC message and the B transmitter provides a B type DC message. The A receiver is responsive to only an A type message and the B receiver is responsive to only a B type message.

7 Claims, 6 Drawing Figures

10
12
14
16
18
20
22
A
B
24
PRECISION CALIBRATED VOLTAGE DIVIDER
26
VOLTAGE CONTROLLED OSCILLATOR
30
ONE-SHOT MUTIVIBRATOR
32
PULSE FORMING NETWORK
36
38
VOLTAGE CHECKER
40
DC-DC CONVERTER
TO RAILS
42
RELAY GATING CKT
TO RECEIVER MODULE
FROM MESSAGE CYCLE TIMER ON RECEIVER
MOD RATE SELECTION (BY EXTERNAL MEANS)

SIGNAL CONTROL SYSTEM

SUMMARY OF THE INVENTION

The present invention relates to railroad signaling systems and in particular to a signaling system using DC pulses of like polarity for transmitting signal messages in opposite directions.

A primary purpose of the invention is a signaling system of the type described in which DC messages of like polarity are distinguished by different address portions of each message.

Another purpose is a signaling system of the type described in which each signal message includes spaced address portions with the interval between the address portions providing the message intelligence.

Another purpose is a railroad signaling system of the type described in which each signal message includes spaced address portions with each address portion comprising spaced DC pulses, with the interval between the leading pulse of each address portion comprising the message intelligence.

Another purpose is a railroad signaling system in which the address portion of each signal message provides directional information.

Another purpose is a railroad signaling system of the type described which provides reliable broken rail protection and satisfactorily operates over substantial distances.

Another purpose is a railroad signaling system of the type described which requires a minimum inventory of different components.

Another purpose is a railroad signaling system which substantially eliminates false indications caused by transients on the rails.

Another purpose is a railroad signaling system which eliminates many of the problems inherent in AC type signaling.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The assignee of the present application has in the past marketed a railroad signaling system in which AC messages were transmitted between a signal transmitter and receiver. The signaling system in question utilized a message format similar to that disclosed herein, however, there was no distinction made between 37 talk time" and "listen time" as the signal messages were transmitted simultaneously in opposite directions. It has long been known in the art that AC signaling messages have certain inherent disadvantages principally in the area of reliability and distance. Also, it was not possible to obtain reliable broken rail protection with AC signaling devices.

There is presently on the market a DC signaling system manufactured by Electro-Pneumatic Corp., of Riverside, Calif., known as "Electro-Code" which uses a message format in which for safety purposes polarity determines the direction of transmission. Such a system also has certain disadvantages primarily due to the inductive isolation devices used to prevent false warnings for a grade crossing. Such induction devices may in fact cause polarity reversal of the signal message, thus causing the signals to show an incorrect track condition.

The present invention eliminates the disadvantages of both of the above-described systems and utilizes a DC type of signaling system, which is acknowledged to be the most reliable, with a message format which provides pulses of the same polarity for transmission in both directions. The receivers are arranged to directionally distinguish between messages by the address portion of the message. The address portion in each case is a pair of pulses with the time interval or spacing between pulses being indicative of the correct direction of transmission. Each receiver is arranged to accept only pulses having a predetermined spacing in the address portion of the message. Although the invention will be described in connection with address pulses using spacing between pulses as an indication of transmission direction, it should be understood that there are other means, using pulses of the same polarity, to distinguish between direction of transmission. For example, the number of pulses in the address may be similarly used.

Figures 1, 2:
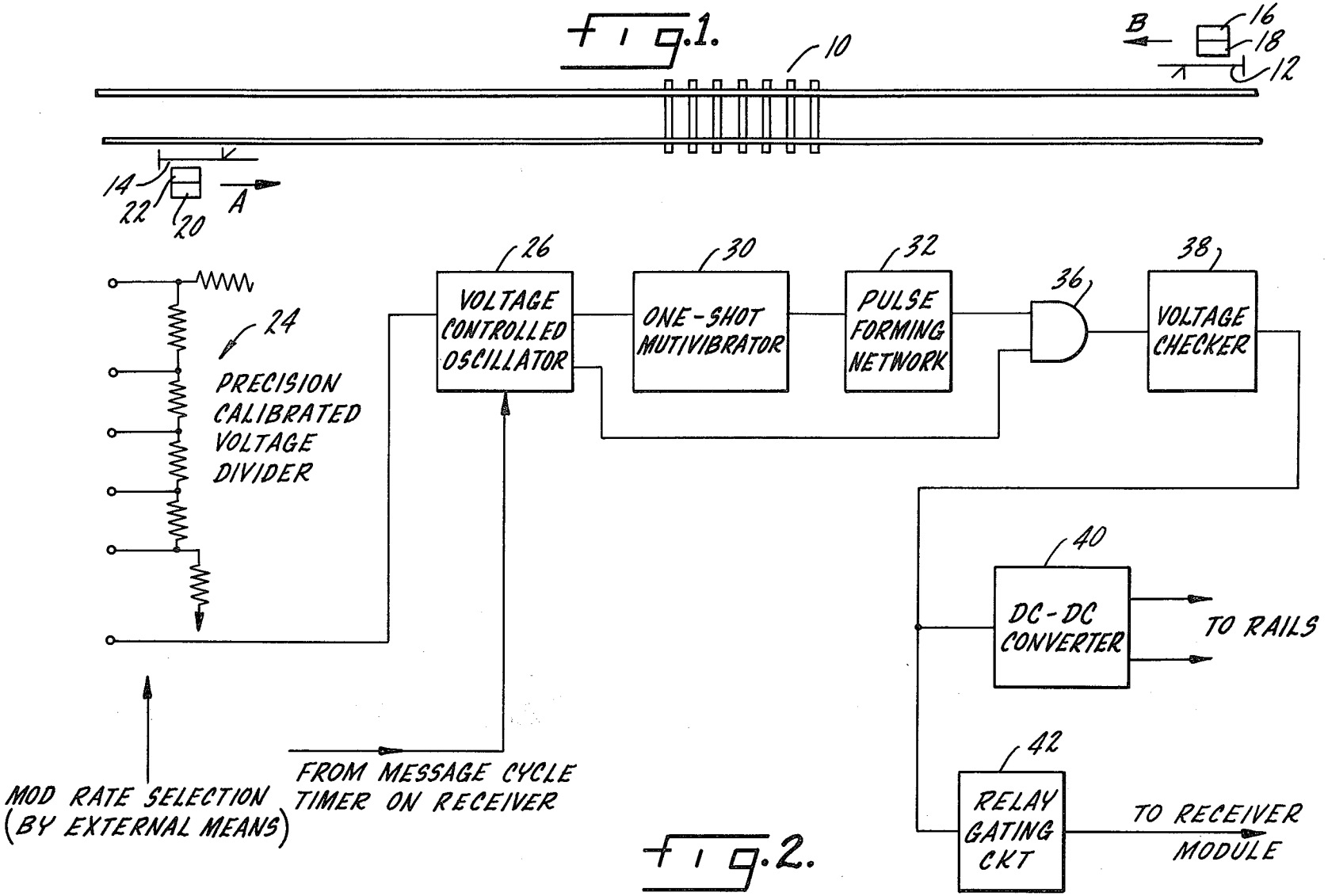
FIG. 1 is a diagrammatic illustration of a signal block illustrating the transmitter, receiver and signals at each end thereof.
FIG. 2 is a block diagram of a transmitter for use in the signaling system of FIG. 1.

Looking at FIG. 1, the signal block of a section of railroad track is indicated at 10 and there may be a signal 12 at the right-hand end and a signal 14 at the left-hand end. Typically, a signal block is approximately 14,000 ft. long, although this length may vary depending upon the speed of trains through the block, the grade, and the weight of the load that the trains would normally carry through that area of track. Normally the length of the block is determined by braking distance because the train must be able to slow down and stop short of the next signal. The A and B directions of transmission are indicated at FIG. 1 and at signal 12 there will be a B transmitter 16 and an A receiver 18 and at signal 14 there will be an A transmitter 20 and a B receiver 22. Normally, there will be other signals associated with each end of the block, those being the signals for the adjacent blocks, but for ease of description only the signals associated with a single block have been disclosed and shown herein.

The transmitter, which may be either an A or B transmitter, is indicated in FIG. 2. A voltage divider network 24 will provide a predetermined voltage for voltage controlled oscillator 26. The particular mode of operation which will be selected by external means not disclosed herein, and conventionally a relay arrangement will determine which of the several available voltages will be provided by the voltage divider network 24 to oscillator 26. Normally such relays and the voltage divider network are arranged so that if different signal conditions are indicated, or if there is a failure, the voltage associated with the signal mode indicating the most dangerous condition will be provided for oscillator 26. The oscillator also receives a signal from the message cycle timer on the receiver which will be described in detail hereinafter. Such a signal either permits the oscillator to operate or not as the overall circuits are arranged so that there will be only one message transmission at a time. The voltage provided to oscillator 26 determines the mode of operation or what signal message will be transmitted down the rails to the related receiver.

Figure 6:
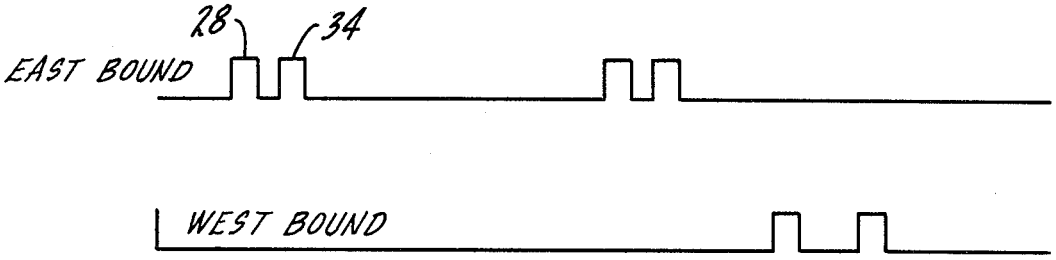
FIG. 6 is a wave form diagram illustrating the message format used in the signaling system disclosed herein.

The output from oscillator 26, looking at FIG. 6, is the first pulse 28 assuming an eastbound or A type message. Such pulse provides the input for multivibrator 30, which delays the pulse and the connected pulse forming network 32 provides the second pulse 34 in the eastbound message. Thus, the two inputs for AND gate 36 are pulses 28 and 34 formed as described. These pulses provide the input for a voltage checker 38 which is primarily a safety device to insure that the voltage applied to oscillator 26 and divider 24 is within predetermined limits. The output from voltage checker 38 goes to a DC-DC converter 40 which in turn is connected to the rails. Converter 40 is an isolation circuit and meets certain Federal railroad regulations and to isolate signaling systems from possible voltage shocks applied to the rails, for example from lightening or the like. The output from voltage checker 38 is also connected to a relay gating circuit 42 which in turn is connected to the receiver module associated with the transmitter. Assuming FIG. 2 represents an A code transmitter, then the associated receiver will be of the B type.

In the signaling system disclosed herein, an eastbound or A type message consists of two address portions indicated in FIG. 6 with each address portion comprising pulses having a duration of 0.07 second and an interval between leading edges of the pulses of 0.13 second. Westbound or B type messages, also shown in FIG. 6, consist similarly of two addresses with the address pulses being of the same width, but the time interval between leading edges of the address pulses being 0.23 second. Thus, the address indicated the direction of transmission and the receivers are so arranged as to be receptive or to react only to address pulses having a particular time interval between the leading edges thereof.

The time interval between addresses is the intelligence of the message. For example, assuming five different modes of operation are to be utilized, there may be a time interval between the address portions of 0.57 second; 0.67 second; 0.77 second; 0.87 second; and 1.00 second. Each of the different modes of operation are for a different track and thus signal condition. The total message will comprise two address portions, the spacing or time interval between the pulses in the address indicating the direction of transmission, i.e. whether an A type or B type message, and the time interval between addresses providing the intelligence, i.e. which particular signal mode is indicated.

Figure 5:
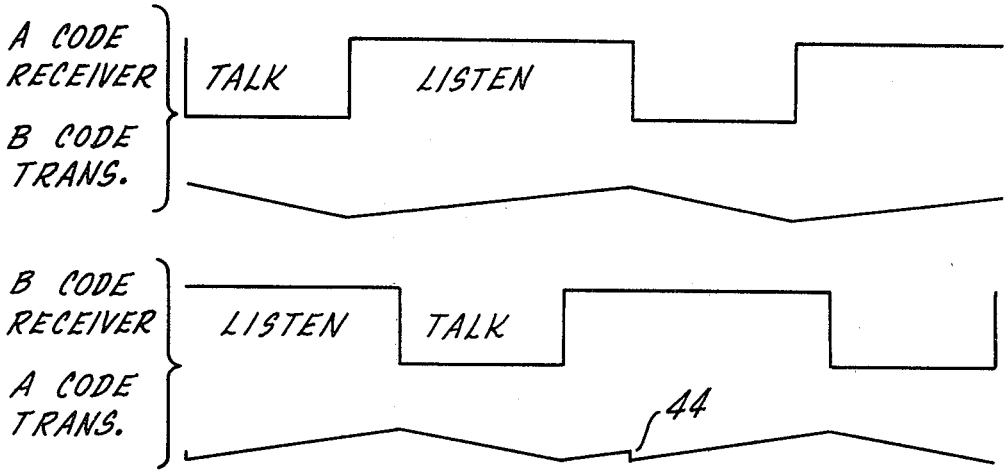
FIG. 5 is a wave form diagram illustrating the control of the respective transmitters and receivers.

Looking at FIG. 5, the top wave form represents the talking and listening periods for an A code receiver and B code transmitter. When the B code transmitter is operated, only the B code receiver will be conditioned to listen. In like manner, when the A code transmitter is operating, only the A code receiver will be conditioned to listen. This relationship is illustrated by the first and third wave forms. The second and fourth wave forms represent the charging and discharging periods of the capacitors which control the message cycle timers. The A code receiver timing capacitor is discharging when the B code transmitter is operating and in like manner the B code receiver timing capacitor is discharging during the period that the A code transmitter is operating. The B code receiver is arranged in a slightly different manner than the A code receiver in order to insure synchronization of the operation of all equipment. Thus, the timing capacitor for the B code receiver, indicated by the bottom wave form in FIG. 5, will immediately discharge as soon as the first pulse from the B code transmitter is received. This is represented at 44 in FIG. 5. The B code receiver will then begin its charging cycle, but there will always be a discharge before initiation of the charging cycle caused by the receipt of the first address pulse from the B code transmitter.

Figure 3:
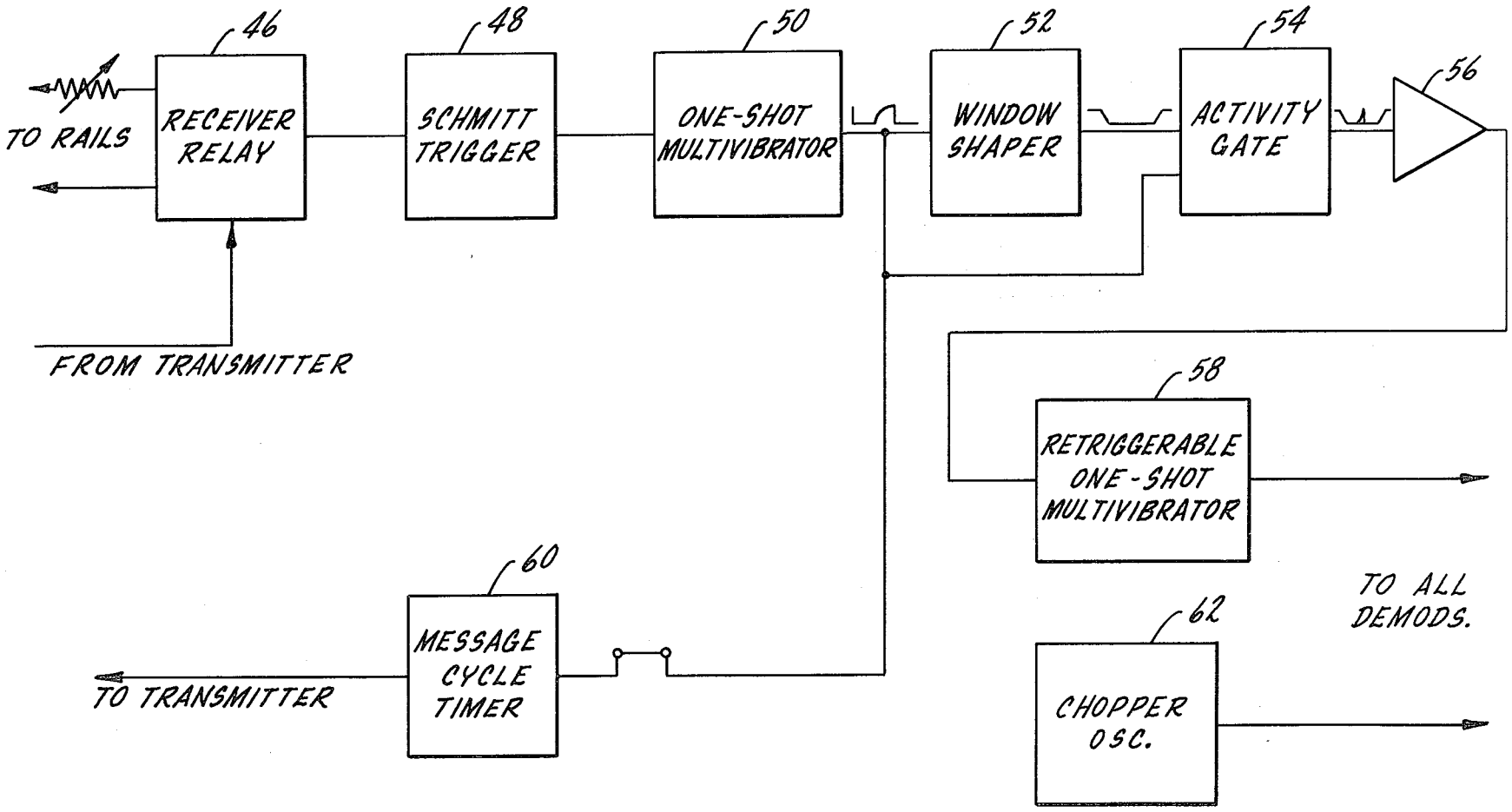
FIG. 3 is a block diagram of the receiver of FIG. 1.

FIG. 3 shows the basic receiver circuitry. A receiver relay 46 is connected to the relay gating circuit of the associated transmitter. When, for example, the B code transmitter is operating, the relay gating circuit will not provide a closed path to receive signals at the associated A code receiver relay. Normally, the receiver relay will be conditioned to receive signals, however, there will be no path for received signals at such time as the associated transmitter is operating.

The input to receiver relay 46 is the output from converter 40, i.e. the message of FIG. 6. Relay 46 is connected to a Schmitt trigger 48 which is effective to clean up the input signal and remove any noise. Thus, the output of the Schmitt trigger is the same two pulse input address signal followed by a second address after a predetermined period. Trigger circuit 48 is connected to a one-shot multivibrator 50 whose output is the wave form shown in FIG. 3 with the leading edge of the first address pulse causing a rapid negative-directed signal followed by a slow rise and then followed by a rapid drop for the leading edge of the second address pulse. The one-shot multivibrator is connected to a window shaper 52 and the resultant wave form from the window shaper will again begin its negative decline about midway in the rise time of the output from multivibrator 50. The output from multivibrator 50 is directly connected to an activity gate 54 as is the output from window shaper 52. The "window" from circuit 52 conditions the activity gate to receive the second pulse in the address from the multivibrator with the resultant wave form, shown at the output of circuit 54, being a negative-directed window with an intermediately positioned very narrow pulse which is the second pulse in the address. The proper output will only be present at gate 54 if the input address has the proper time interval between pulses. It is this arrangement in the receiver which permits the receiver to distinguish between A code and B code messages and thus a receiver is only arranged to receive one type of message, i.e. a message in which there is a particular time interval between the two address pulses.

An amplifier 56 is connected to the output of gate 54 and the output from the amplifier, which is essentially the input but in amplified form, is connected to a retriggerable one-shot multivibrator 58. The output from multivibrator 58 is a 0.3 second negative pulse for each input address.

A message cycle timer is indicated at 60 and is connected to the input of multivibrator 50 in a B code type receiver. It is this connection which provides the rapid discharge of the timing capacitor in the message cycle timer, illustrated in FIG. 5, and is effective to synchronize the operation of all receivers and transmitters. The output from message cycle timer 60 is connected to oscillator 26 on the transmitter as illustrated in FIG. 2.

The message cycle timer for an A code transmitter is similar to the B code transmitter, except that the above-described connection is not present. Thus, the A code receiver will run through its timing cycle, i.e. charge and discharge in accordance with the circuit components and without external synchronization.

Figure 4:
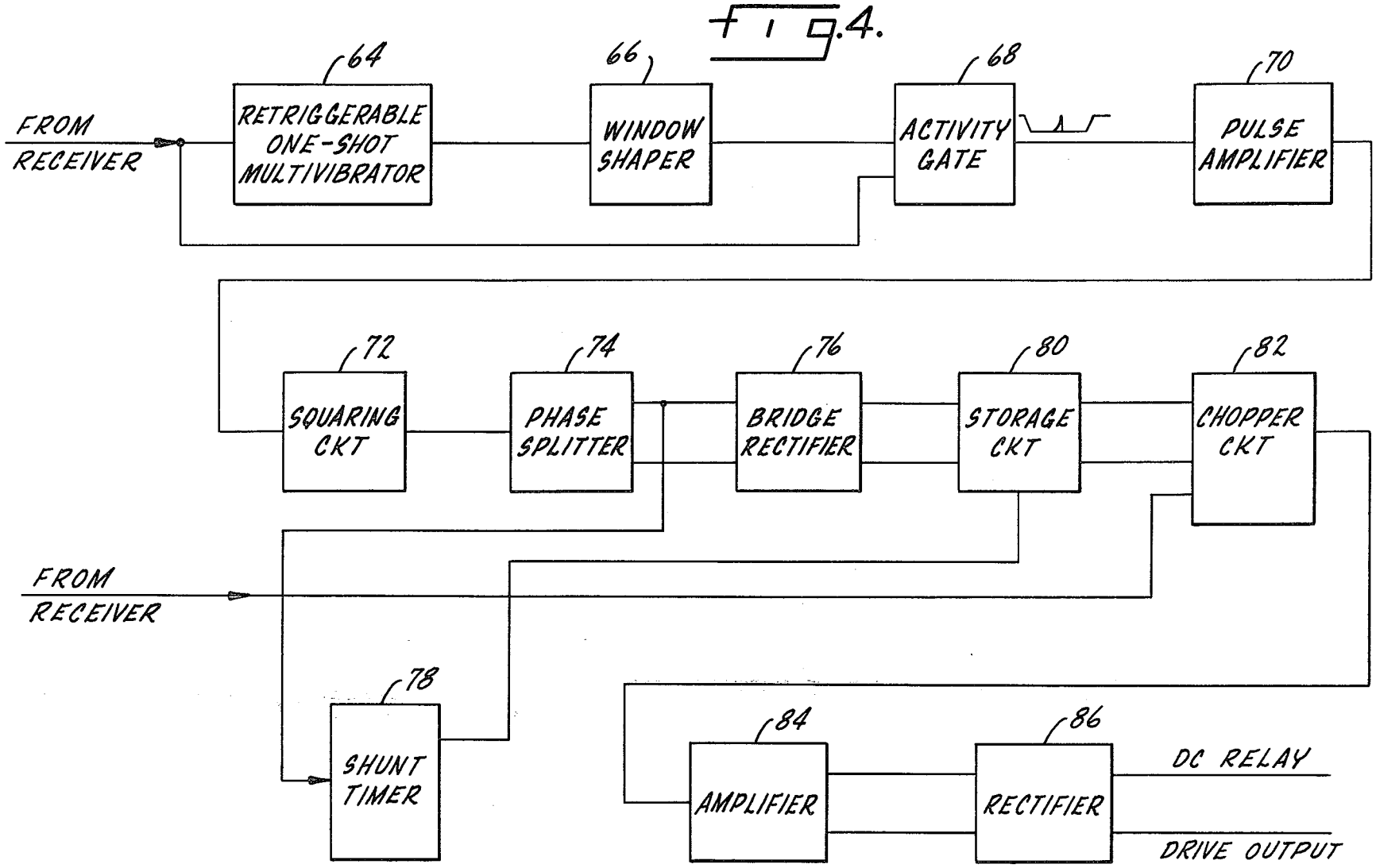
FIG. 4 is a block diagram of one of the demodulators associated with the signal system reevier.

The receiver is completed by a chopper oscillator 62 which provides a pulse output having a frequency of approximately 4 khz. Both oscillator 62 and multivibrator 58 are connected to a series of demodulators, one of which is illustrated in FIG. 4. There is a separate demodulator for each possible mode of operation of a particular signal. Each demodulator will be formed and arranged to react to only one interval between addresses, i.e. each mode of operation of the signal system.

Looking at FIG. 4, the output from multivibrator 58 is connected to a retriggerable one-shot multivibrator 64 whose output is a positive going pulse which begins at the end of the 0.3 second negative pulse from the receiver multivibrator 58. Assuming a mode 1 demodulator in which the message interval is 1.0 second, the output from multivibrator 64 will remain at the described positive level for 0.66 second. This output is connected to a window shaper 66 whose output in turn is connected to an activity gate 68. The window shaper performs the same function as did circuit 52 of the receiver in that it conditions the activity gate to receive a subsequent signal. In this case, the activity gate is connected directly to receiver multivibrator 58. Thus, the second address in a particular message which again will be in the form of a 0.3 second negative going pulse from multivibrator 58 will arrive at the activity gate slightly after the end of the 0.66 second positive pulse from multivibrator 64. The end result is that two addresses with the appropriate message space between will provide an output from the activity gate similar to that illustrated in connection with gate 54 in that there is a window with an intermediate sharply defined pulse which in fact is the second address in the message.

Assuming a mode 1 condition and a B code message, the total time of the message is 1.3 seconds. Although such a message is longer than the 1.1 second talk period of the transmitter, the message is still received since it is only necessary that the first pulse of the second address be transmitted or formed by oscillator 26 before the inhibit signal is applied to the oscillator from its associated receiver. The second pulse of the address is formed as described from the first pulse. Thus, even though a receiver may shut off its associated transmitter, providing the first pulse in the second address is formed, the completed message will be transmitted and received.

The output from activity gate 68, a sharply defined pulse, is amplified in amplifier 70 and connected to a squaring circuit 72. The output from squaring circuit 72 is a pulse of approximately 0.5 second duration which is connected to a phase splitter 74 which provides both positive and negative pulses which are in turn applied to a bridge rectifier 76.

The positive output from phase splitter 74 is connected to a shunt timer 78. This circuit has a timing period of approximately 3.5 seconds which is slightly longer than the three second repeat period of messages in a single direction. Thus, this timer will normally merely cycle and it will not effect the operation of the demodulators unless a train appears within the block which will change the signal condition. Rectifier 76 is connected to a storage circuit 80 whose output is a negative DC voltage which is applied to chopper circuit 82. This circuit also receives an input from chopper oscillator 62. Thus, the output from circuit 82, assuming all previous circuits have been operated in the appropriate manner by signals of correct time periods, will be a 4 khz square wave which will be amplified by circuit 84, subsequently rectified by circuit 86 and then used to drive the DC relay which will hold the signals in a particular condition. Storage circuit 80 which is essentially a capacitor device provides the power to hold the signal relays in a particular condition, as it wll maintain its negative output to chopper circuit 82 during the period that no message is actually being received by a particular receiver, i.e. the period when the opposite transmitter and receiver are functioning for signal messages transmitted in the opposite direction.

Shunt timer 78 is effective to disable its demodulator in the event a new signal message has not been received to maintain the signal in a particular condition. Thus, the timing period of 3.5 seconds for timer 78 is slightly longer than the message repeat period of 3.0 seconds. In this connection, it is to be recognized that the most delay that would ever occur when a train enters the block is the 3.5 seconds necessary for circuit 78 to time out.

Of particular importance in the present application is the use of different address formats for messages in different directions. Thus, the address is in fact the directional information. The intelligence of the message or the particular mode of operation or condition which the signal should show is determined by the interval between message addresses. Each message consists of two addresses with the address conditioning the receiver and the interval between addresses conditioning a selected demodulator of which there is one for each possible signal condition.

Whereas the preferred form of the invention has been shown and described herein, it should be realized that there may be many modifications, substitutions and alterations thereto.

The embodiments of the invention in which an exclusive property or privilege is claimed are defined as follows:

1. A railroad signaling system including an A transmitter and A receiver for sending and receiving signal messages in one direction and a B transmitter and B receiver for sensing and receiving signal messages in the opposite direction, said A transmitter and B receiver being located at one end of a signal block and said B transmitter and A receiver being located at the other end, said A transmitter including means for providing an A type DC message, said B transmitter including means for providing a B type DC message, said A receiver being responsive to only an A type message and said B receiver being responsive to only a B type message, both said A and B type messages including address portions having different pulse characteristics providing directional information, each of said A and B type receivers including means for inhibiting said B and A type transmitters, respectively, whereby only one transmitter operates at a time.

2. The signaling system of claim 1 further characterized in that both said A and B messages include address portions formed by a plurality of spaced pulses.

3. The signaling system of claim 2 further characterized in that said address portions include a pair of spaced pulses, with the pulse interval being different for the A and B type messages.

4. The signaling system of claim 1 further characterized in that said A and B messages each include spaced address portions, with each address portion consisting of spaced pulses.

5. The signaling system of claim 4 further characterized in that the address portions of said A and B messages each consist of a pair of spaced pulses with the interval between address pulses in an A type message being different from that of a B type message.

6. The signaling system of claim 4 further characterized in that the time interval between said address portions provides the intelligence transmitted by said A and B type messages.

7. The signaling system of claim 1 further characterized in that each of said A and B type receivers include message cycle timers for inhibiting either said B or A type transmitters, respectively.

* * * * *